US006820969B2

(12) United States Patent
Miyata

(10) Patent No.: US 6,820,969 B2
(45) Date of Patent: Nov. 23, 2004

(54) LIQUID-JET HEAD AND LIQUID-JET APPARATUS

(75) Inventor: Yoshinao Miyata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 94 days.

(21) Appl. No.: 10/395,850

(22) Filed: Mar. 25, 2003

(65) Prior Publication Data

US 2003/0218657 A1 Nov. 27, 2003

(30) Foreign Application Priority Data

Mar. 25, 2002 (JP) ..... 2002-083877
Apr. 2, 2002 (JP) ..... 2002-099862
Nov. 5, 2002 (JP) ..... 2002-321083

(51) Int. Cl.[7] ..... B41J 2/045
(52) U.S. Cl. ..... 347/71
(58) Field of Search ..... 347/68–72

(56) References Cited

U.S. PATENT DOCUMENTS

2003/0085961 A1 * 5/2003 Furuhata ..... 347/68

FOREIGN PATENT DOCUMENTS

JP 5-286131 11/1993

* cited by examiner

*Primary Examiner*—Judy Nguyen
(74) *Attorney, Agent, or Firm*—Sughrue Mion, PLLC

(57) ABSTRACT

Disclosed are a liquid-jet head that is capable of maintaining ejection characteristics of liquid droplets, obtaining stable ink ejection characteristics, and arraying piezoelectric elements in high density, and a liquid-jet apparatus. An ink-jet recording head includes: a passage-forming substrate in which pressure generating chambers communicating with nozzle orifices are formed; and piezoelectric elements for generating pressure changes in the pressure generating chambers, which are provided on one surface side of the passage-forming substrate with vibration plate interposed therebetween. In the ink-jet recording head, a resistance reduction portion is provided to reduce a resistance of a common electrode common to the plurality of piezoelectric elements when a voltage is applied to the piezoelectric elements. The resistance reduction portion includes: common lead electrodes extracted from portions of the common electrode, which exclude both end portions in a direction where the piezoelectric elements are provided parallel, to outside regions opposite the pressure generating chambers; and connection wiring composed of a bonding wire.

16 Claims, 9 Drawing Sheets

LIQUID-JET HEAD AND LIQUID-JET APPARATUS

BACKGROUND OF THE INVENTION

1. Field of the Invention

The present invention relates to a liquid-jet head that ejects jets of liquid and to a liquid-jet apparatus. More particularly, the present invention relates to an ink-jet recording head that pressurizes, by piezoelectric elements, ink supplied to pressure generating chambers communicating with nozzle orifices that eject ink droplets to eject the ink droplets from the nozzle orifices, and relates to an ink-jet recording apparatus.

2. Description of the Related Art

Two types of heads are put into practical use in an ink-jet recording head, in which pressure generating chambers that communicate with nozzle orifices ejecting ink droplets are partially constituted of vibration plate. The vibration plate is deformed by piezoelectric elements to pressurize ink in the pressure generating chambers, and the ink droplets are ejected from the nozzle orifices. One is a recording head using piezoelectric actuators of a longitudinal vibration mode which expand and contract in an axis direction of the piezoelectric elements, and the other is a recording head using piezoelectric actuators of a flexural vibration mode.

In the former type, a volume of each pressure generating chamber can be changed by abutting an end surface of the piezoelectric element against the vibration plate, and manufacturing of a head suitable to high density printing is made possible. On the contrary, while this is possible, it requires a difficult process of cutting and dividing the piezoelectric element in a comb tooth shape in accordance with an array pitch of the nozzle orifices and work of positioning and fixing the cut and divided piezoelectric elements to the pressure generating chambers. Thus, there is a problem of a complex manufacturing process. On the other hand, in the latter one, the piezoelectric elements can be fabricated and installed on the vibration plate by a relatively simple process of adhering a green sheet of a piezoelectric material while fitting a shape thereof to that of the pressure generating chambers and baking the green sheet. However, a certain area of the vibration plate is required due to use of the flexural vibration, thus there is a problem that a high density array of the piezoelectric elements is difficult.

Meanwhile, in order to solve such a disadvantage of the latter recording head, a recording head is proposed, in which an even piezoelectric material layer is formed over the entire surface of a vibration plate by a deposition technology, the piezoelectric material layer is cut and divided into a shape corresponding to that of pressure generating chambers by a lithography method, and piezoelectric elements are formed so as to be independent of each other for each pressure generating chamber (refer to, for example, Japanese Patent Laid-Open No. Hei 5(1993)-286131).

Accordingly, the work of adhering the piezoelectric elements to the vibration plate is eliminated, and there are advantages in that not only can the piezoelectric elements be fabricated and installed by a precise and simple method that is the lithography method but also the thickness of each piezoelectric element can be thinned to enable a high-speed drive.

SUMMARY OF THE INVENTION

However, in the ink-jet recording head in which the piezoelectric elements are arrayed in high density as described above, one electrode (common electrode) is provided commonly to the plurality of piezoelectric elements. Therefore, when a large number of piezoelectric elements are driven simultaneously to eject a large number of ink droplets at one time, a voltage drop occurs and the amounts of displacement of the piezoelectric elements become unstable, causing a problem of lowering ink ejection characteristics. Moreover, a voltage, which is applied to a piezoelectric element provided on a position farther from a terminal portion to which external wiring is connected, is apt to be lowered. Therefore, there is a problem of variations in ejection characteristics of liquid droplets depending on distances from the terminal portion even in piezoelectric elements provided parallel in one row.

Although such problems as described above can be solved by thickening the thickness of the common electrode of the piezoelectric elements, a problem occurs that the amounts of displacement of the vibration plate, which is generated by the drive of the piezoelectric elements, are lowered because the common electrode generally constitutes a part of the vibration plate. Although the problems as described above can be solved also by expanding the area of the common electrode, there is a problem that the head is enlarged. Moreover, an electrode of a piezoelectric element formed of a thin film has a relatively high resistance value because a film thickness thereof is thin, and therefore, the problems as described above are particularly apt to occur therein.

As another means for solving the problems as described above, there is a recording head, in which a plurality of lower electrode films (lower electrodes) are divided into several groups and each common terminal is provided so as to correspond to each of the groups, thus controlling the voltage drop in attempt to equalize the properties of actuators (piezoelectric elements) (refer to, for example, Japanese Patent Laid-Open No. 2002-11877).

With such a structure, the occurrences of voltage drop are able to be controlled; however, the number of terminals is increased to such a great extent that the wiring structure becomes complicated. Therefore, there are problems that the manufacturing process becomes complicated and that it is difficult to adopt the structure when the piezoelectric element is arrayed in high density. Note that such problems needless to say exist in the manufacturing method of other liquid-jet heads that eject something other than ink, similarly to the manufacturing method of an ink-jet recording head that ejects ink.

In consideration of such circumstances as described above, it is an object of the present invention to provide a liquid-jet head that is capable of maintaining the ejection characteristics of the liquid droplets, obtaining stable ejection characteristics and arraying the piezoelectric elements in high density, and to provide a liquid-jet apparatus.

A first aspect of the present invention that attains the foregoing object is a liquid-jet head comprising: a passage-forming substrate in which pressure generating chambers communicating with nozzle orifices are formed; and piezoelectric elements for generating pressure changes in the pressure generating chambers, the piezoelectric elements being provided on one surface side of the passage-forming substrate with vibration plate interposed therebetween, characterized in that a resistance reduction portion is provided to reduce a resistance of a common electrode common to the plurality of piezoelectric elements when a voltage is applied to the piezoelectric elements, the resistance reduction portion including; common lead electrodes extracted from portions of the common electrode, the portions excluding both end portions in a direction where the piezoelectric elements are provided parallel, to outside regions opposite with the pressure generating chambers; and connection wiring composed of a bonding wire.

In the first aspect, the resistance value of the common electrode when a voltage is applied to the piezoelectric elements is substantially lowered by the resistance reduction portion. Therefore, the voltage drop can be prevented from being generated when the plurality of piezoelectric elements are driven simultaneously. Accordingly, the ejection characteristics of liquid droplets are stabilized without being varied. Moreover, the common lead electrodes are connected to one another by a connection wiring composed of a bonding wire, and thus the head is not enlarged, and the piezoelectric elements can be arrayed in high density relatively easily.

A second aspect of the present invention is the liquid-jet head according to the first aspect, characterized in that the plurality of common lead electrodes are extracted from the common electrode, and the common lead electrodes are connected to one another by the connection wiring.

In the second aspect, the occurrence of the voltage drop can be prevented more assuredly, and the variations in ejection characteristics for each of the nozzle orifices can be prevented with certainty.

A third aspect of the present invention is the liquid-jet head according to anyone of the first and second aspects, further comprising: a sealing plate joined to the piezoelectric element side of the passage-forming substrate, the sealing plate having a piezoelectric element holding portion to seal the piezoelectric element, characterized in that an exposed portion into which surfaces of the common lead electrodes are exposed is provided in a part of the sealing plate, and the connection wiring is provided in the exposed portion.

In the third aspect, the common lead electrodes can be connected, to one another even if the area of the exposed portion is relatively small, and the head can be miniaturized with certainty.

A fourth aspect of the present invention is the liquid-jet head according to any one of the first to third aspects, characterized in that the connection wiring is extended in a direction approximately perpendicular to a direction where the common lead electrodes are provided parallel.

In the fourth aspect, the common lead electrodes can be connected securely to one another in a relatively small region, and the head can be miniaturized with certainty.

A fifth aspect of the present invention is the liquid-jet head according to the third aspect, further comprising: an auxiliary wiring layer made of a conductive material on the sealing plate, characterized in that the auxiliary wiring layer is electrically connected to the common electrode and the common lead electrodes in a region corresponding to an outside of a row of the pressure generating chambers by the connection wiring extended through the exposed portion to constitute a part of the resistance reduction portion.

In the fifth aspect, the resistance value of-the common electrode is further lowered by providing the auxiliary wiring layer, therefore when the plurality of piezoelectric elements are driven, the voltage drop can be prevented more assuredly.

A sixth aspect of the present invention is the liquid-jet head according to the third aspect, characterized in that a drive IC is provided on the upper surface of the sealing plate, a conductive portion is provided on the drive IC, and the conductive portion is electrically connected to the common lead electrodes by the connection wiring to constitute a part of the resistance reduction portion.

In the sixth aspect, the resistance value of the common electrode can be substantially lowered, and the voltage drop does not occur even if a large number of the piezoelectric elements are driven simultaneously, therefore, the ejection characteristics are stabilized. Moreover, the head is not enlarged because the common lead electrodes are made conductive to one another through the conductive portion on the drive IC.

A seventh aspect of the present invention is the liquid-jet head according to the sixth aspect, characterized in that the conductive portion includes a plurality of conductive layers provided intermittingly in an island shape on the drive IC and coupling wiring composed of bonding wires, the coupling wiring electrically connecting the conductive layers to one another.

In the seventh aspect, the plurality of common lead electrodes can be made mutually conductive easily and securely, and the resistance value of the common electrode can be lowered assuredly.

An eighth aspect of the present invention is the liquid-jet head according to the sixth aspect, characterized in that the conductive portion is a conductive layer provided continuously on the drive IC across the direction where the piezoelectric elements are provided parallel.

In the eighth aspect, the plurality of common lead electrodes can be made mutually conductive easily and securely, and the resistance value of the common electrode can be lowered assuredly.

A ninth aspect of the present invention is the liquid-jet head according to any one of the first to eighth aspects, characterized in that the common lead electrodes are composed of a same layer as that of the common electrode.

In the ninth aspect, the common lead electrodes can be formed simultaneously when the common electrode is formed, and the manufacturing process can be simplified.

A tenth aspect of the present invention is the liquid-jet head according to any one of the first to eighth aspects, characterized in that the common lead electrodes are composed of a same layer as that of individual lead electrodes extracted from individual electrodes of the piezoelectric elements.

In the tenth aspect, the resistance value of the common electrode can be lowered more effectively. Moreover, the manufacturing process is simplified because the common lead electrodes can be formed simultaneously when the individual lead electrodes are formed.

An eleventh aspect of the present invention is the liquid-jet head according to any one of the first to tenth aspects, characterized in that the common lead electrodes are extended in a same direction as a direction where individual lead electrodes extracted from individual electrodes of the piezoelectric elements are extended.

In the eleventh aspect, the plurality of common lead electrodes can be extended easily without enlarging the head.

A twelfth aspect of the present invention is the liquid-jet head according to any one of the first to tenth aspects, characterized in that the common lead electrodes are extended in a direction contrary to a direction where individual lead electrodes extracted from individual electrodes of the piezoelectric elements are extended.

In the twelfth aspect, it is possible to secure a relatively wide space for forming the common lead electrodes and the connection wiring therein, and the common lead electrodes and the connection wiring can be formed relatively easily.

A thirteenth aspect of the present invention is the liquid-jet head according to any one of the first to twelfth aspects, characterized in that at least three of the common lead electrodes are provided at an approximately constant interval.

In the thirteenth aspect, the variations in voltage to be applied to the piezoelectric elements can be controlled even if a large number of the piezoelectric elements are driven simultaneously to cause the voltage drop, A fourteenth aspect of the present invention is the liquid-jet head according to any one of the first to thirteenth aspects, characterized in that two rows of the pressure generating chambers formed by a plurality of compartment walls in the passage-forming substrate are provided, and the common lead electrodes are extended to a region corresponding to a space between the rows of the pressure generating chambers.

In the fourteenth aspect, the head can be miniaturized with more certainty because the common lead electrodes can be extended effectively from the common electrode in the regions corresponding to the two rows of the pressure generating chambers.

A fifteenth aspect of the present invention is the liquid-jet head according to any one of the first to fourteenth aspects, characterized in that the pressure generating chambers are formed in a single crystal silicon substrate by anisotropic etching, and respective layers of the piezoelectric elements are formed by deposition and lithography methods.

In the fifteenth aspect, the liquid-jet heads having high-density nozzle orifices can be manufactured relatively easily in a large quantity.

A sixteenth aspect of the present invention is a liquid-jet apparatus comprising the liquid-jet head according to any one of the first to fifteenth aspects.

In the sixteenth aspect, a liquid-jet apparatus can be realized, in which the ejection characteristics of liquid droplets are stabilized, and thus reliability is improved.

DESCRIPTION OF THE PREFERRED EMBODIMENTS

The present invention will be described below in detail based on embodiments.

[Embodiment 1]

Figure 1:
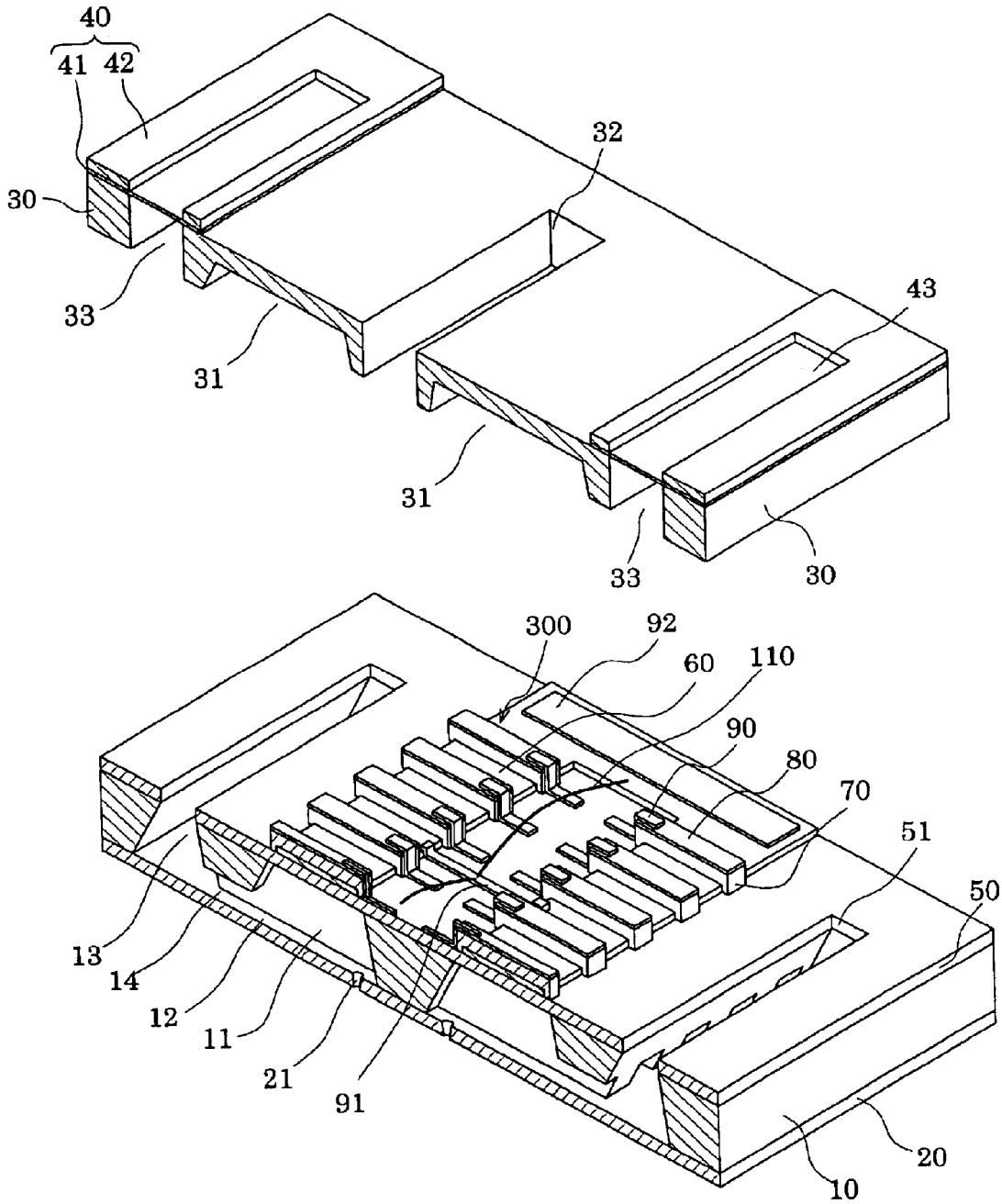
FIG. 1 is an exploded perspective view of a recording head according to Embodiment 1.
Figure 2A:
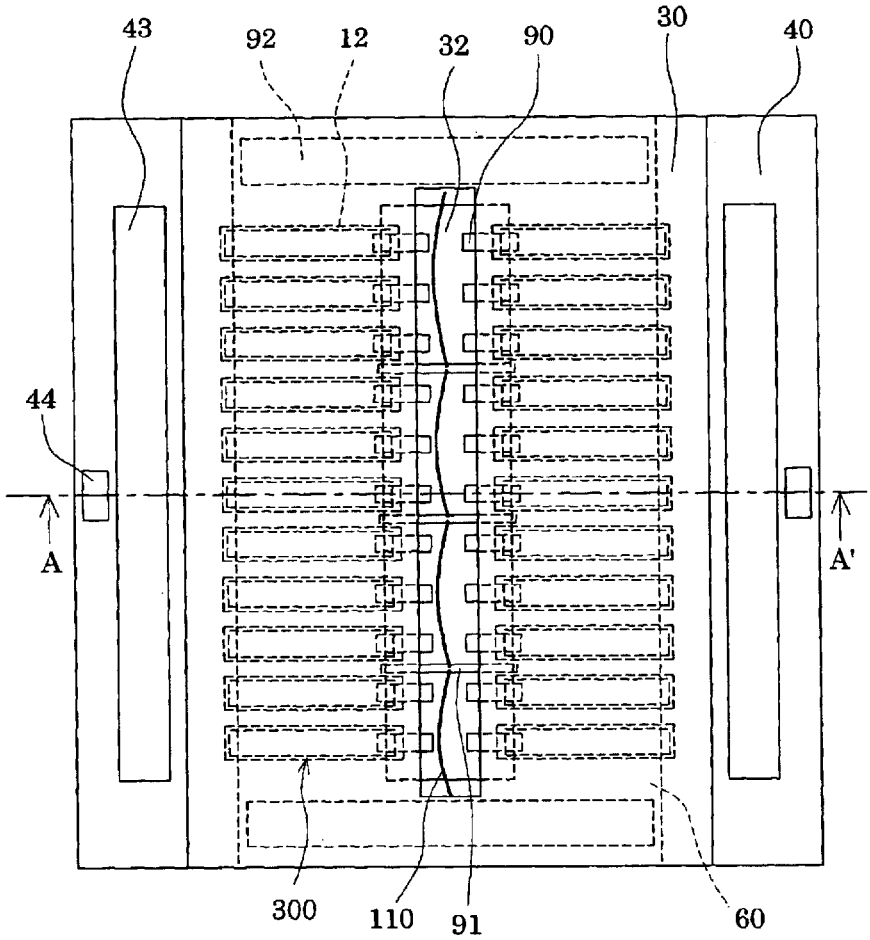
FIGS. 2A and 2B are plan and cross-sectional views of the recording head according to Embodiment 1, respectively.
Figure 2B:
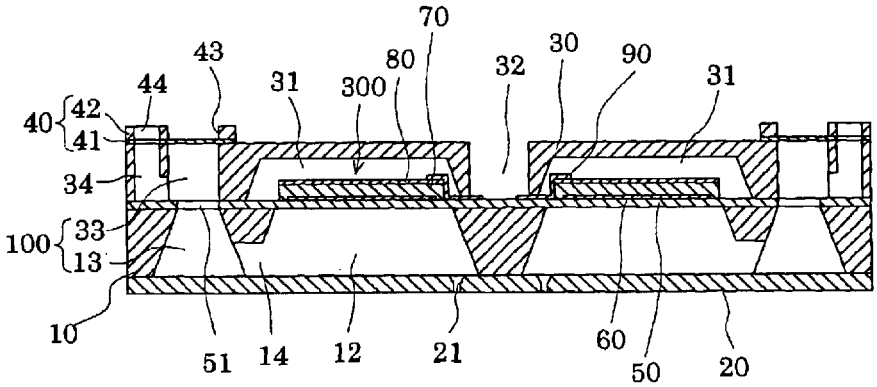

FIG. 1 is an exploded perspective view showing an ink-jet recording head according to Embodiment 1 of the present invention, and FIGS. 2A and 2B are plan and cross-sectional views of FIG. 1. As illustrated, the passage-forming substrate 10 is composed of a single crystal silicon substrate of a plane orientation (110) In this embodiment. One surface of the passage-forming substrate 10 becomes an opening surface, and on the other surface, the elastic film 50 having a thickness ranging from 1 to 2 $\mu$m is formed, which is made of silicon dioxide, formed in advance by thermal oxidation. Meanwhile, on the opening surface of the passage-forming substrate 10, two rows of the pressure generating chambers 12 partitioned by the plurality of compartment walls 11 are provided parallel in the width direction by anisotropic etching on the single crystal silicon substrate. On the outside in the longitudinal direction, the communicating portions 13 that partially constitute the reservoirs 100 are formed, the reservoirs 100 communicating with the reservoir portions 33 provided in the sealing plate 30 to be described later and, serving as common ink chambers to the respective pressure generating chambers 12. The communicating portions 13 are made to communicate individually with one end of the longitudinal direction ends of the pressure generating chambers 12 through the ink supply paths 14.

Here, the anisotropic etching is carried out by utilizing a difference in etching rate of the single crystal silicon substrate. For example, in this embodiment, the anisotropic etching is carried out by utilizing the following property of the single crystal silicon substrate. When the single crystal silicon substrate is immersed in an alkaline solution such as KOH, it is gradually eroded, and there emerge the first (111) plane perpendicular to the (110), plane and the second (111) plane forming an angle of about 70 degrees to the first (111) plane and an angle of about 35 degrees to the above-described (110) plane. As compared with the etching rate of the (110) plane, the etching rate of the (111) plane is about 1/180. With such anisotropic etching, it is possible to perform high-precision processing based on depth processing in a parallelogram shape formed of two of the first (111) planes and two of the second (111) planes slant thereto, so that the pressure generating chambers 12 can be arrayed in high density.

In this embodiment, the long sides of the respective pressure generating chambers 12 are formed of the first (111) planes, and the short sides thereof are formed of the second (111) planes. These pressure generating chambers 12 are formed by carrying out etching substantially through the passage-forming substrate 10 to reach the elastic film 50. Here, the erosion of the elastic film 50 by the alkaline solution used for etching the single crystal silicon substrate is extremely small. Moreover, the respective ink supply paths 14 communicating with the one ends of the pressure generating chambers 12 are formed to be shallower than the pressure generating chambers 12, so that passage resistance of ink flowing into the pressure generating chambers 12 is maintained constant. Specifically, the ink supply paths 14 are formed by etching the single crystal silicon substrate partway (half-etching) in the thickness direction. Note that the half-etching is carried out by adjusting an etching time.

Note that, in regards to the thickness of the passage-forming substrate 10, in which the pressure generating chambers 12 and the like as described above are formed, it is preferable to select the optimal thickness in accordance with the array density of the pressure generating chambers 12. For example if the array density of the pressure generating chambers 12 is set at about 180 dots per inch (180 dpi), then it is suitable that the thickness of the passage-forming substrate 10 be in a range from 180 to 280 μm, and more preferably, about 220 μm. Moreover, for example if the array density of the pressure generating chambers 12 is set at a relatively high density such as about 360 dpi, then it is preferable to set the thickness of the passage-forming substrate 10 at 100 μm or less. This is because the array density can be increased while maintaining the rigidity of each compartment wall between the neighboring pressure generating chambers 12.

On the opening surface side of the passage-forming substrate 10, the nozzle plate 20, in which the nozzle orifices 21 are drilled, is fixedly adhered via an adhesive agent or a thermo welding film or the like, each nozzle orifice 21 communicating with the pressure generating chamber 12 at an end contrary to the ink supply path 14 thereof. Note that the nozzle plate 20 is made of glass, ceramics, stainless steel or the like having a thickness of, for example, 0.1 to 1 mm and a linear expansion coefficient of, for example, 2.5 to 4.5 [$\times 10^{-6}$/° C.] at a temperature of 300° C. or lower. With one surface, the nozzle plate 20 entirely covers one side of the passage-forming substrate 10, and serves a role of a reinforcement plate for protecting the single crystal silicon substrate from an impact or an external force. Moreover, the nozzle plate 20 may be formed of a material having a thermal expansion coefficient approximately equal to that of the passage-forming substrate 10. In this case, the passage-forming substrate 10 and the nozzle plate 20 can be joined easily to each other by use of a thermosetting adhesive agent and the like because deformations of the passage-forming substrate 10 and the nozzle plate 20 due to heat become approximately the same. Here, the size of the pressure generating chambers 12 that apply ink droplet ejection pressures to ink and the size of the nozzle orifices 21 that eject ink droplets are optimized in accordance with an amount of ink droplets to be elected, an ejection speed thereof, an ejection frequency thereof and the like. For example, in the case where 360 dots of ink droplets per one inch are recorded, it is necessary that the nozzle orifices 21 be precisely formed with a diameter of several dozen micrometers.

Meanwhile, on the elastic film 50, on the side which is opposite with the opening surface of the passage-forming substrate 10, the lower electrode film 60 having a thickness of, for example, about 0.2 μm, the piezoelectric layers 70 having a thickness of, for example, about 1 μm, and the upper electrode films 80 having a thickness of, for example, about 0.1 μm are formed in a stacked state in a process to be described later, thus constituting the piezoelectric elements 300. Here, each piezoelectric element 300 means a portion including the lower electrode film 60, the piezoelectric layer 70 and the upper electrode film 80. In general, the piezoelectric element 300 is constituted such that any one of electrodes thereof is made to be a common electrode, and that the other electrode and the piezoelectric layer 70 are patterned for each pressure generating chamber 12. Here, a portion, which is constituted of the patterned one of electrodes and the patterned piezoelectric layer 70, and where a piezoelectric distortion is generated by application of a voltage to both of the electrodes, is referred to as a piezoelectric active portion. In this embodiment, the lower electrode film 60 is made to be the common electrode to the piezoelectric elements 300, and the upper electrode film 90 is to be an individual electrode of each piezoelectric element 300. However, there are no detrimental effects even if the above-described order is reversed for the convenience of a drive circuit and wiring. In any of the cases, the piezoelectric active portion will be formed for each pressure generating chamber. In addition, here, a combination of the piezoelectric element 300 and a vibration plate in which displacement occurs due to the drive of the piezoelectric element 300, is referred to as a piezoelectric actuator.

Here, the Individual lead electrode 90, which is extracted from the vicinity of the end portion of the piezoelectric element 300 in the longitudinal direction to the region outside the pressure generating chamber 12, is individually connected to the upper electrode film 80, used as the individual electrode of the piezoelectric element 300. The individual lead electrode 90 is made of, for example, gold (Au) In this embodiment, the individual lead electrode 90 is extended from the vicinity of the end portion of the piezoelectric element 300 in the longitudinal direction to the region corresponding to the space between the rows of the pressure generating chambers 12. Moreover, in this embodiment, the lower electrode film 60 as the common electrode in the piezoelectric elements 300 is patterned on the regions opposite with the vicinities of the both end portions of the pressure generating chambers 12 in the longitudinal direction and is extended along the direction where the pressure generating chambers 12 are provided parallel to the outside region of the rows thereof. Then, the lower electrode film 60 in the regions corresponding to the rows of the pressure generating chambers 12 is in continuation on the region outside of the rows of the pressure generating chambers 12.

Moreover, the plurality of common lead electrodes 91 extracted from portions of the lower electrode film 60, which exclude the end portions in the direction where the pressure generating chambers 12 are provided parallel, to the outside region of the pressure generating chambers 12 are connected to the lower electrode film 60 in the region opposite the rows of the pressure generating chambers 12. In this embodiment, these common lead electrodes 91 are extended to the region corresponding to the space between the rows of the pressure generating chambers 12 and are continuously provided across the lower electrode film 60 in the region opposite the rows of the pressure generating chambers 12. Note that the common lead electrodes 91, needless to say, may be provided independently in the lower electrode film 60 for each region thereof corresponding to the row of the pressure generating chambers 12.

Although it is satisfactory if at least one of these common lead electrodes 91 is provided, it is preferable at least three thereof be provided at a constant interval, for example, at a ratio of 1 to n, where n is the number of the individual lead electrodes 90. Moreover, it is preferable to use a material having at least a lower resistance value than the lower electrode film 60, for the common lead electrodes 91. The common lead electrodes 91 may be formed of the same material as that of the lower electrode film 60, however, in this embodiment, the common lead electrodes 91 are formed of the same layer as that of the individual lead electrodes 90.

Moreover, such common lead electrodes 91 as described above are electrically connected to the lower electrode film 60 in the region corresponding to the outside of the rows of the pressure generating chambers 12 by the connection wiring 110 which is composed of a bonding wire. In this embodiment, the connection wiring 110 is provided in the penetrated portion 32 provided in the sealing plate 30 to be described later and is extended to the direction approximately perpendicular to the direction where the common lead electrodes 91 are extended. Then, at least one of the common lead electrodes 91 and the lower electrode film 60 are electrically connected by the connection wiring 110, and the adjacent common lead electrodes 91 are electrically connected to one another by the connection wiring 110. Thus, all of the common lead electrodes 91 are electrically connected to the lower electrode film 60. Needless to say, the connection wiring 110 may be provided individually between the common lead electrodes 91 and the lower electrode film 60. Note that the stacked electrode layer 92 formed of a material having at least a lower resistance value than the lower electrode film 60, that is, formed of the same layer as that of the individual lead electrodes 90 in the present embodiment, is further provided on the lower electrode film 60 in the region corresponding to the outside of the rows of the pressure generating chambers 12.

As described above, in this embodiment, the plurality of common lead electrodes 91 are provided at a constant interval and are electrically connected to one another by the connection wiring 110 formed of a bonding wire. Therefore, stable ink ejection characteristics can be always obtained. Specifically, a constitution is adopted, in which resistance reduction portions composed of the common lead electrodes 91 and the connection wiring 110 are provided and the resistance value of the lower electrode film 60 is substantially lowered when a voltage is applied to the piezoelectric elements 300. Therefore, the occurrence of the voltage drop can be prevented even if a large number of the piezoelectric elements 300 are driven simultaneously, and the stable ink ejection characteristics can be obtained. In particular, because the stacked electrode layer 92 is provided on the lower electrode film 60 in this embodiment, the resistance value of the lower electrode film 60 can be lowered more assuredly.

Moreover, because the common lead electrodes 91 are adapted to be electrically connected to one another, the variations in voltage to be applied to the piezoelectric elements 300 are controlled even if a voltage drop occurs. Accordingly, the variations in amount of displacement of the piezoelectric elements 300 are controlled, and the ejection characteristics of ink to be ejected from the nozzle orifices 21 are made uniform. Furthermore, because the common lead electrodes 91 are adapted to be electrically connected by the connection wiring 110 composed of a bonding wire, the common lead electrodes 91 can be connected more securely to one another even in a relatively small region. Accordingly, the piezoelectric elements 300 can be arrayed in high density without enlarging the head, and good ink ejection characteristics can be obtained.

Note that the sealing plate 30, which has the piezoelectric element holding portions 31 sealing spaces in a state where the spaces are maintained sufficient so as not to hinder the movements of the piezoelectric elements 300, is joined onto the piezoelectric element 300 side of the passage-forming substrate 10. In this embodiment, the piezoelectric element holding portions 31 individually seal the regions facing to the piezoelectric elements 300, that is, the rows of the piezoelectric elements 300 individually provided in the regions opposite with the rows of the pressure generating chambers 12. Moreover, the penetrated portion 32 penetrating through the sealing plate 30 in the thickness direction is provided between the piezoelectric element holding portions 31, that is, in the region corresponding to the center portion of the sealing plate. Then, the common lead electrodes 91 extracted from the lower electrode film 60 are partially exposed into the penetrated portion 32, and the common lead electrodes 91 are electrically connected to one another by the connection wiring 110 extended in the penetrated portion 32.

As described above, in this embodiment, the common lead electrodes 91 are adapted to be electrically connected to one another by the connection wiring 110 composed of a bonding wire. Therefore, the connection wiring 110 can be formed easily even if the opening area of the penetrated portion 32 of the sealing plate 30 is made relatively small. Moreover, the vicinities of the end portions of the individual lead electrodes 90 extracted from the upper electrode films 80 are also exposed in the penetrated portion 32 similarly to the common lead electrodes 91, and are connected to a drive IC and the like for driving the piezoelectric elements 300 through drive wiring extended through the penetrated portion 32 though not being illustrated.

Moreover, the reservoir portions 33, each constituting at least a part of the reservoir 100 serving as a common ink chamber to the pressure generating chambers 12, are provided in the sealing plate 30. In this embodiment, the reservoir portions 33 are formed penetrating through the sealing plate 30 in the thickness direction across the width direction of the pressure generating chambers 12. The reservoir portions 33 are made to communicate with the communicating portions 13 of the passage-forming substrate 10 through the penetrated holes 51 provided penetrating through the elastic film 50, thus constituting the reservoirs 100 serving as common ink chambers to the pressure generating chambers 12. For the sealing plate 30, it is preferable to use a material having a thermal expansion coefficient approximately equal to that of the passage-forming substrate 10, for example, a glass material, a ceramic material and the like. In this embodiment, a single crystal silicon substrate that is the same material as that for the passage-forming substrate 10 is used to form the sealing plate 30.

Moreover, the compliance plates 40, each being composed of the sealing film 41 and the fixing plate 42, are joined onto the sealing plate 30. Here, the sealing films 41 are formed of a flexible material having low rigidity (for example, a polyphenylene sulfide (PPS) film having a thickness of 6 $\mu$m), and seal one surface of each of the reservoir portions 33. Moreover, the fixing plates 42 are formed of a hard material such as metal,(for example, a stainless steel (SUS) having a thickness of 30 $\mu$m). The region of each fixing plate 42, which faces to the reservoir 100, is removed completely in the thickness direction to define the opening portion 43. Therefore, one surface of each reservoir 100 is sealed only by the flexible sealing film 41. Moreover, the ink introducing ports 44 for supplying ink to the reservoirs 100 are formed on the compliance plates 40 on the outsides of the approximate center portions of the reservoirs 100 in the longitudinal direction. Furthermore, the ink introducing paths 34, each allowing the ink introducing port 44 and the sidewall of the reservoir 100 to communicate with each other, are provided in the sealing plate 30.

The ink-jet recoding head of the present embodiment as described above takes in ink from an unillustrated external ink supplying means through the ink introducing ports 44 and the ink introducing paths 34, and fills with ink the inside thereof from the reservoirs 100 through the nozzle orifices 21. Then, the ink-jet recording head applies a voltage between the lower electrode film 60 and the upper electrode film 80, both of them corresponding to each pressure generating chamber 12, in accordance with a recording signal from an unillustrated drive circuit, and allows the elastic film 50, the lower electrode film 60 and the piezoelectric layers 70 to undergo the flexural deformation. Thus, the pressure in the pressure generating chambers 12 is increased, and the ink droplets are ejected from the nozzle orifices 21.

[Embodiment 2]

Figure 3:
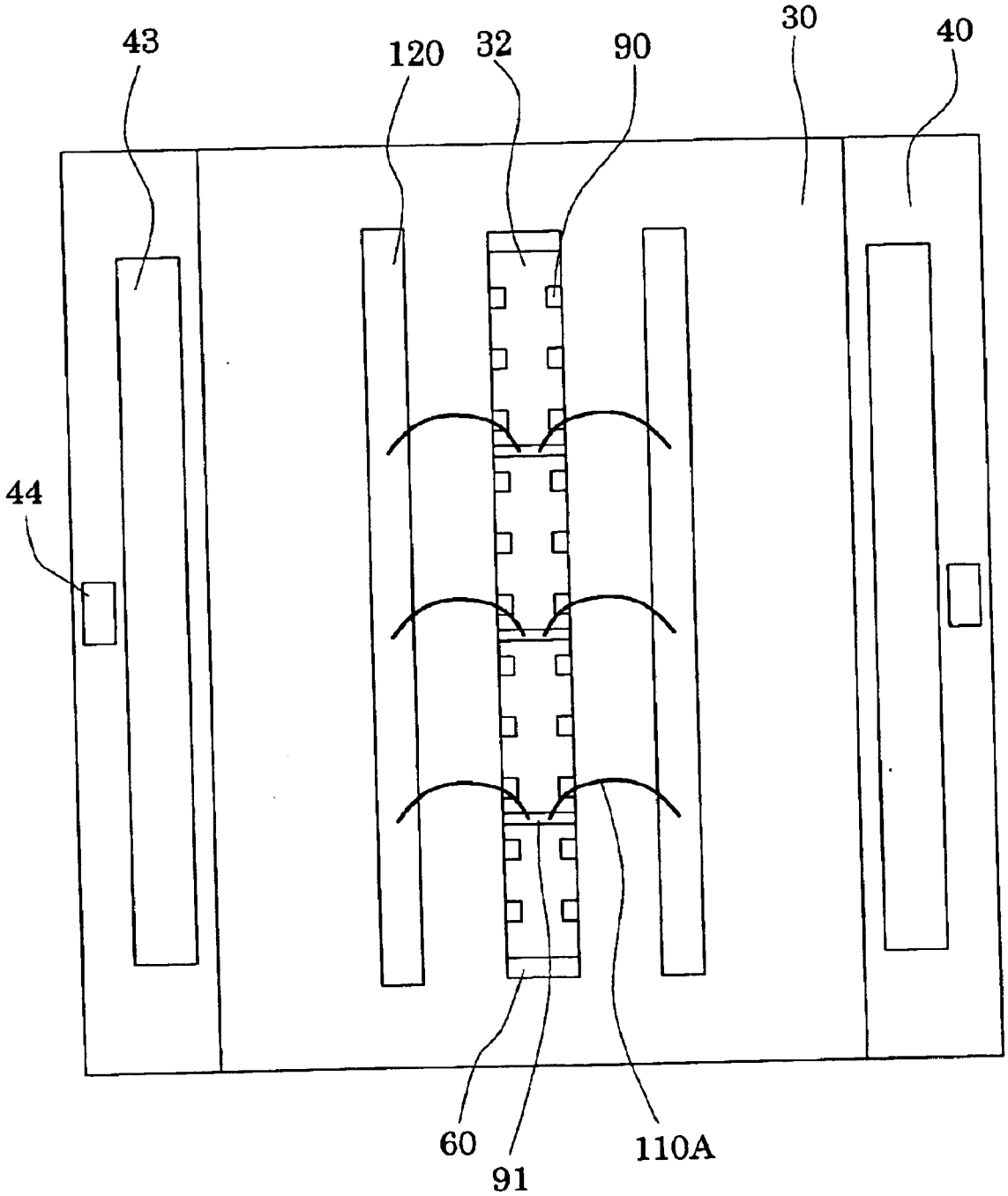
FIG. 3 is a plan view of a recording head according to Embodiment 2.

FIG. 3 is a plan view of an ink-jet recording head according to Embodiment 2.

This embodiment is an example where the auxiliary wiring layers 120 are provided on the sealing plate 30, and the common lead electrodes 91 are adapted to be electrically connected to one another through the auxiliary wiring layers 120. Specifically, this embodiment is an example of providing resistance reduction portions composed of the common lead electrodes 91, the connection wiring 110A and the auxiliary wiring layers 120. As shown in FIG. 3, the auxiliary wiring layers 120 made of a conductive material are provided individually on the regions of the sealing plate 30, which correspond to the rows of the pressure generating chambers 12. Moreover, the auxiliary wiring layers 120 are electrically connected to the common lead electrodes 91 by the connection wiring 110A made of bonding wires. Other than the above, this embodiment is similar to Embodiment 1.

With such a constitution, the common lead electrodes 91 are electrically connected to one another by the connection wiring 110A and the auxiliary wiring layers 120, and the resistance value of the lower electrode film 60 is substantially lowered, similarly to Embodiment 1. In this embodiment, particularly, the auxiliary wiring layers 120 work to suppress even further the resistance value of the lower electrode film 60. Accordingly, the occurrence of the voltage drop can be prevented more assuredly, and stable ink ejection characteristics are always able to be obtained.

[Embodiment 3]

Figure 4:
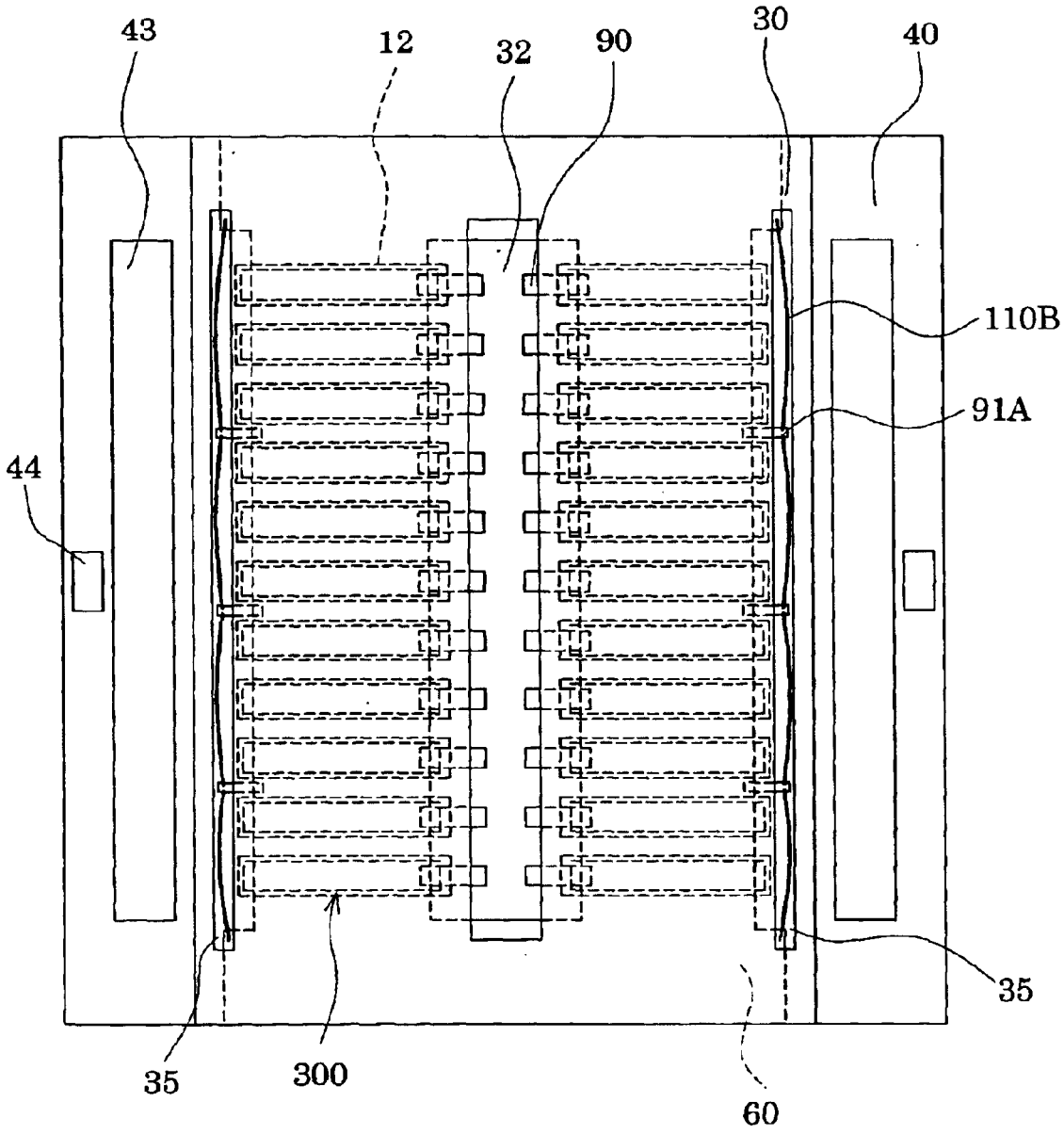
FIG. 4 is a plan view of a recording head according to Embodiment 3.

FIG. 4 is a view showing a wiring structure of an ink-jet recording head according to Embodiment 3. This embodiment is an example where the common lead electrodes 91A are adapted to be extended in a direction contrary to the direction where the individual lead electrodes 90 are extended. In this embodiment, the common lead electrodes 91A are extended from the end portion sides of the lower electrode film 60, which are contrary to the individual lead electrodes 90 of the piezoelectric elements 300, onto the elastic film 50 as shown in FIG. 4. Moreover, the second penetrated portions 35 are provided in the sealing plate 30 between the piezoelectric element holding portions 31 and the reservoir portions 33, and the vicinities of the end portions of the common lead electrodes 91A are exposed thereinto. The connection wiring 110B composed of bonding wires is extended in the second penetrated portions 35 in a direction approximately perpendicular to the direction where the common lead electrodes 91A are extended. The common lead electrodes 91A are electrically connected to the lower electrode film 60 in the outside regions of the rows of the pressure generating chambers 12 through this connection wiring 110B. Other than the above, this embodiment is similar to Embodiment 1. Also with such a constitution, the resistance value of the lower electrode film 60 can be substantially lowered as a matter of course, and an effect similar to those of the above-described embodiments can he obtained.

[Embodiment 4]

Figure 5:
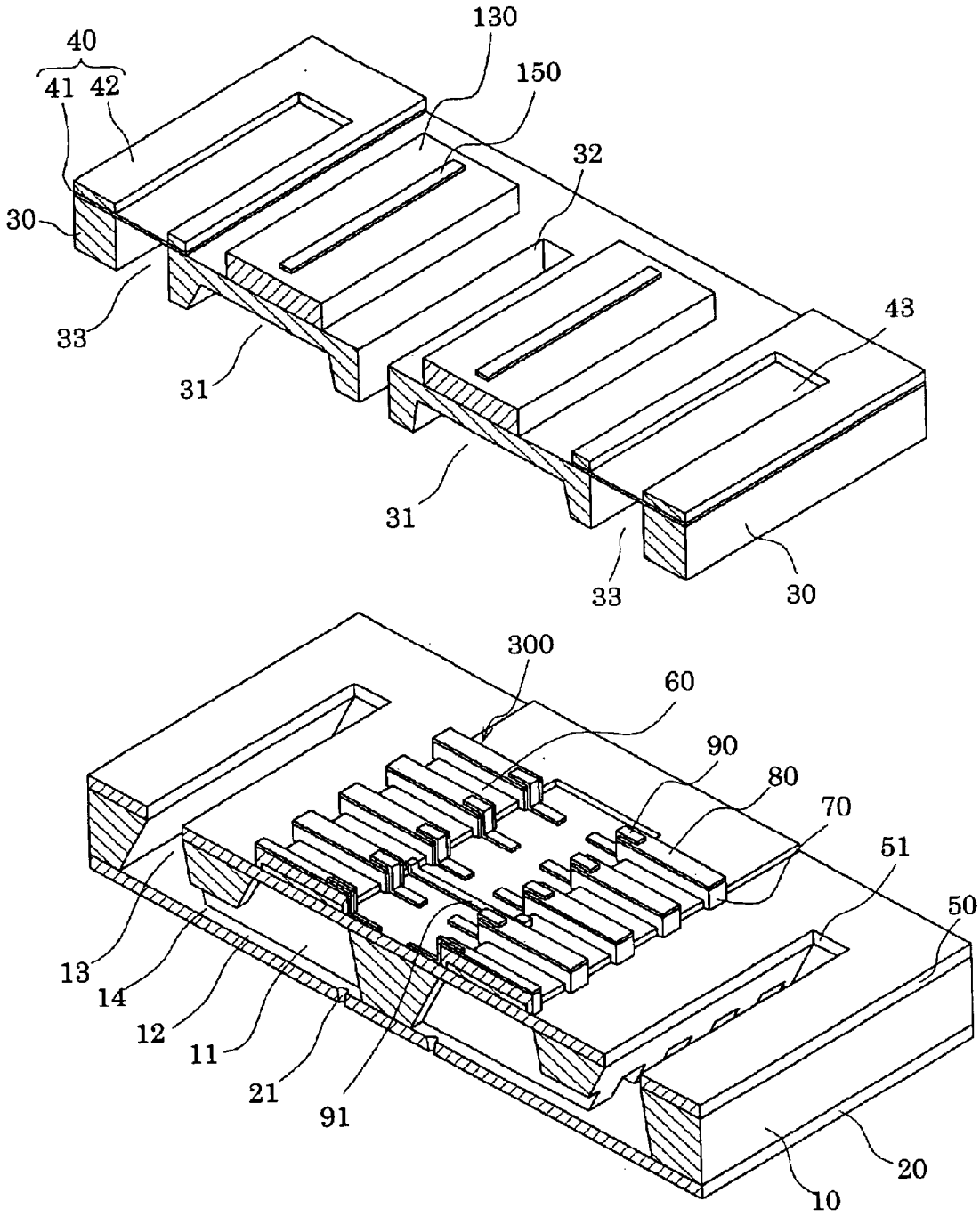
FIG. 5 is an exploded perspective view of a recording head according to Embodiment 4.
Figure 6:
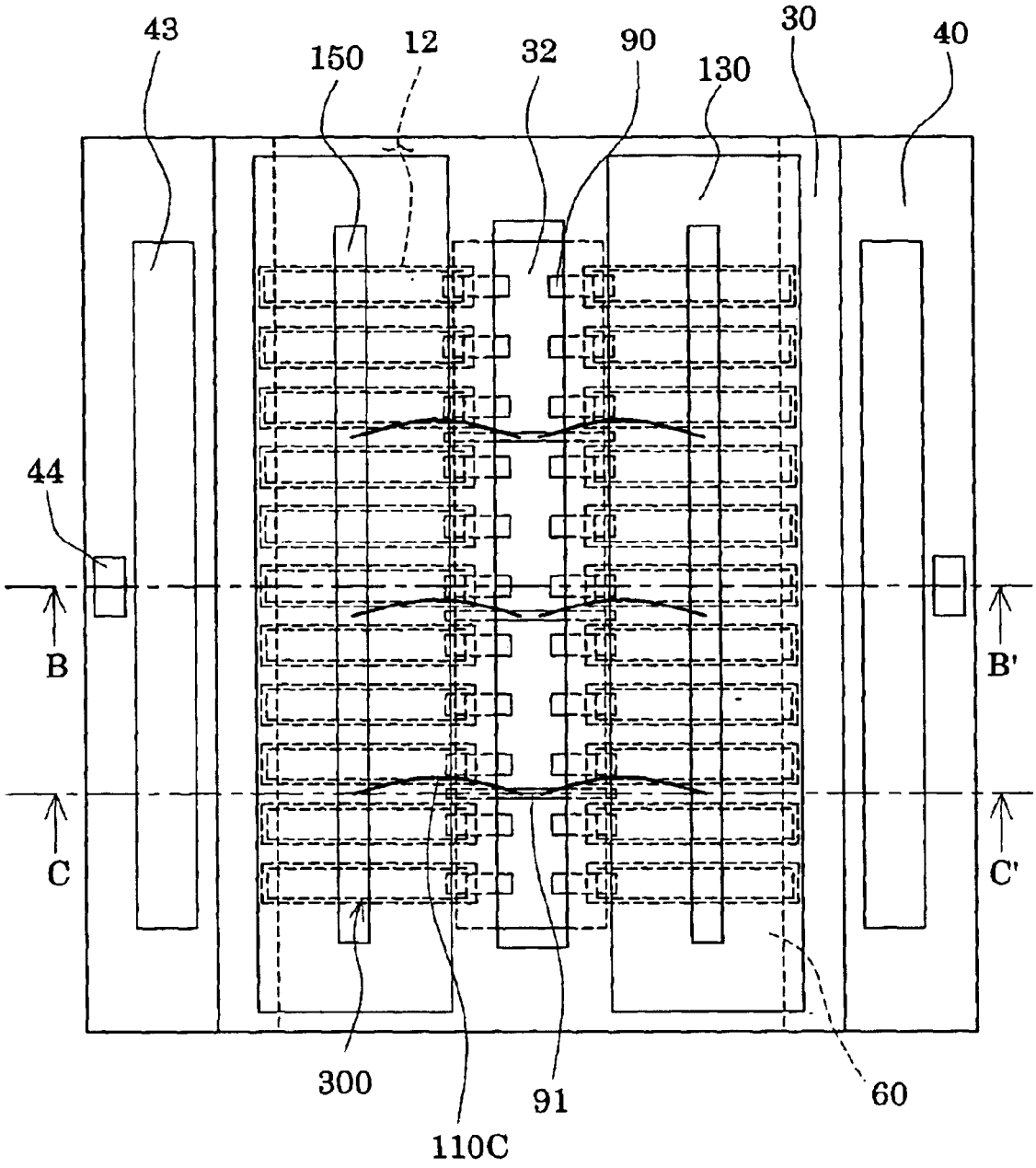
FIG. 6 is a plan view of the recording head according to Embodiment 4.
Figure 7A:
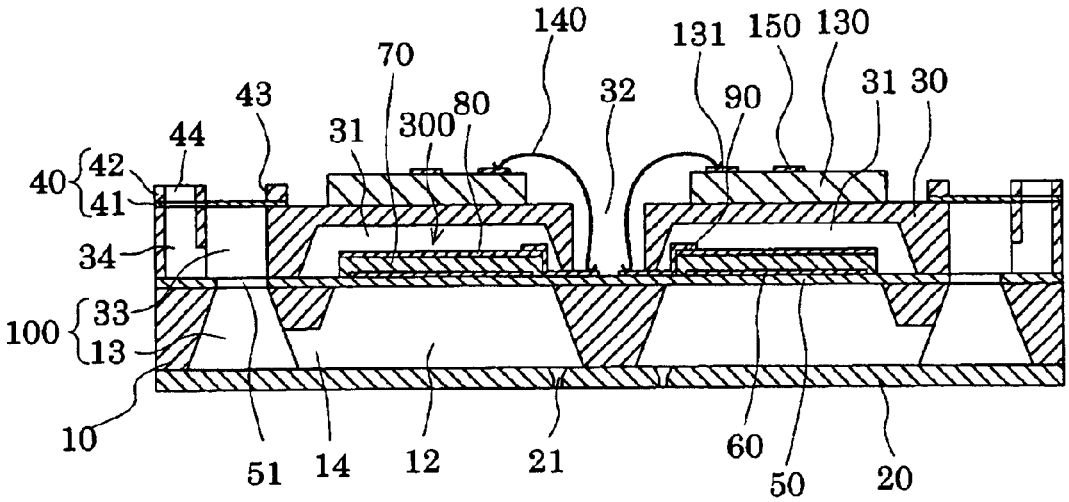
FIGS. 7A and 7B are cross-sectional views of the recording head according to Embodiment 4.
Figure 7B:
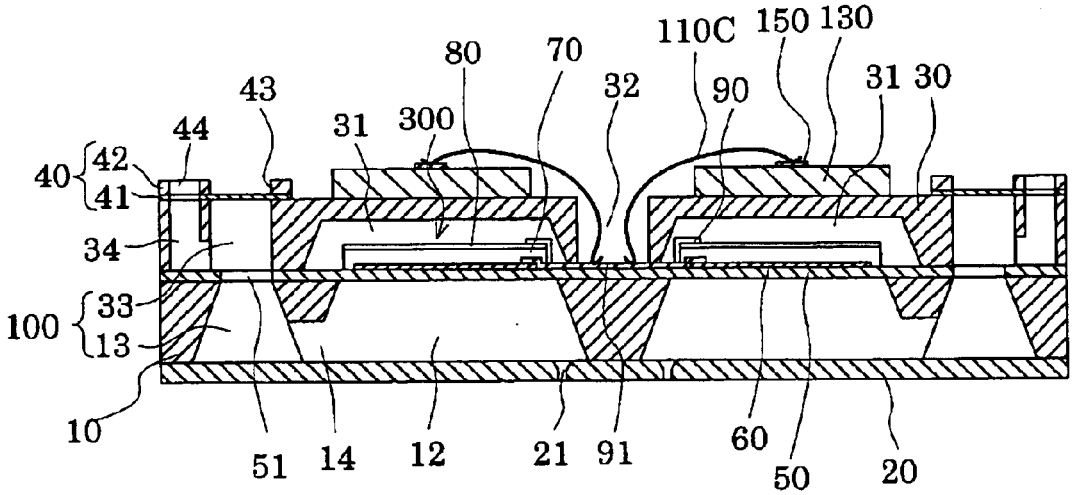

FIG. 5 is an exploded perspective view of an ink-jet recording head according to Embodiment 4. FIG. 6 is a plan view thereof, and FIGS. 7A and 7B are cross-sectional views taken along the line B–B' and the line C–C' in FIG. 6, respectively. This embodiment is an example where drive ICs for driving the piezoelectric elements 300 are mounted on the sealing plate 30 and the resistance reduction portions are constituted of conductive portions and connection wiring, which are provided on the drive ICs. Specifically, as shown in FIGS. 5 to 7B, two drive ICs 130 for driving the piezoelectric elements 300 for each row are fixed on both sides of the penetrated portion 32 of the sealing plate 30. Moreover, the terminals 131 of the drive ICs 130 are electrically connected to the vicinities of the end portions of the individual lead electrodes 90, which are exposed into the penetrated portion 32, through the drive wiring 140 composed of conductive wires such as, for example, bonding wires. Furthermore, the conductive layers 150 made of a conductive material such as metal are provided on the upper surfaces of the drive ICs 130 across the direction where the piezoelectric elements 300 are provided parallel. Then, the conductive layers 150, and the portions of the common lead electrodes 91 which are exposed into the penetrated portion 32, are electrically connected to each other by the connection wiring 110C composed of the bonding wire. Thus, the resistance reduction portions are constituted of the common lead electrodes 91, the connection wiring 110C and the conductive layers 150. Other than the above, this embodiment is similar to Embodiment 1.

As described above, the plurality of common lead electrodes 91 are extended from the lower electrode film 60 as the common electrode at a predetermined interval, and the plurality of common lead electrodes 91 are made electrically conductive through the conductive layers 150 provided on the upper surfaces of the drive ICs 130. Thus, the resistance value of the lower electrode film 60 can be substantially lowered. Accordingly, the occurrence of the voltage drop can be prevented when a large number of the piezoelectric elements 300 are driven simultaneously. Particularly, the variations in voltage to the piezoelectric elements 300 can be controlled, which are caused on the both end sides and the center portion in the direction where the piezoelectric elements 300 are provided, and stable ink ejection characteristics can be always obtained. Furthermore, the common lead electrodes 91 are made mutually conductive not on the passage-forming substrate 10 but by using conductive layers 150 on available space on top of the drive ICs 130. Therefore, the miniaturization of the head can be achieved because enlarging the area of the passage-forming substrate 10 is not necessary.

[Embodiment 5]

Figure 8:
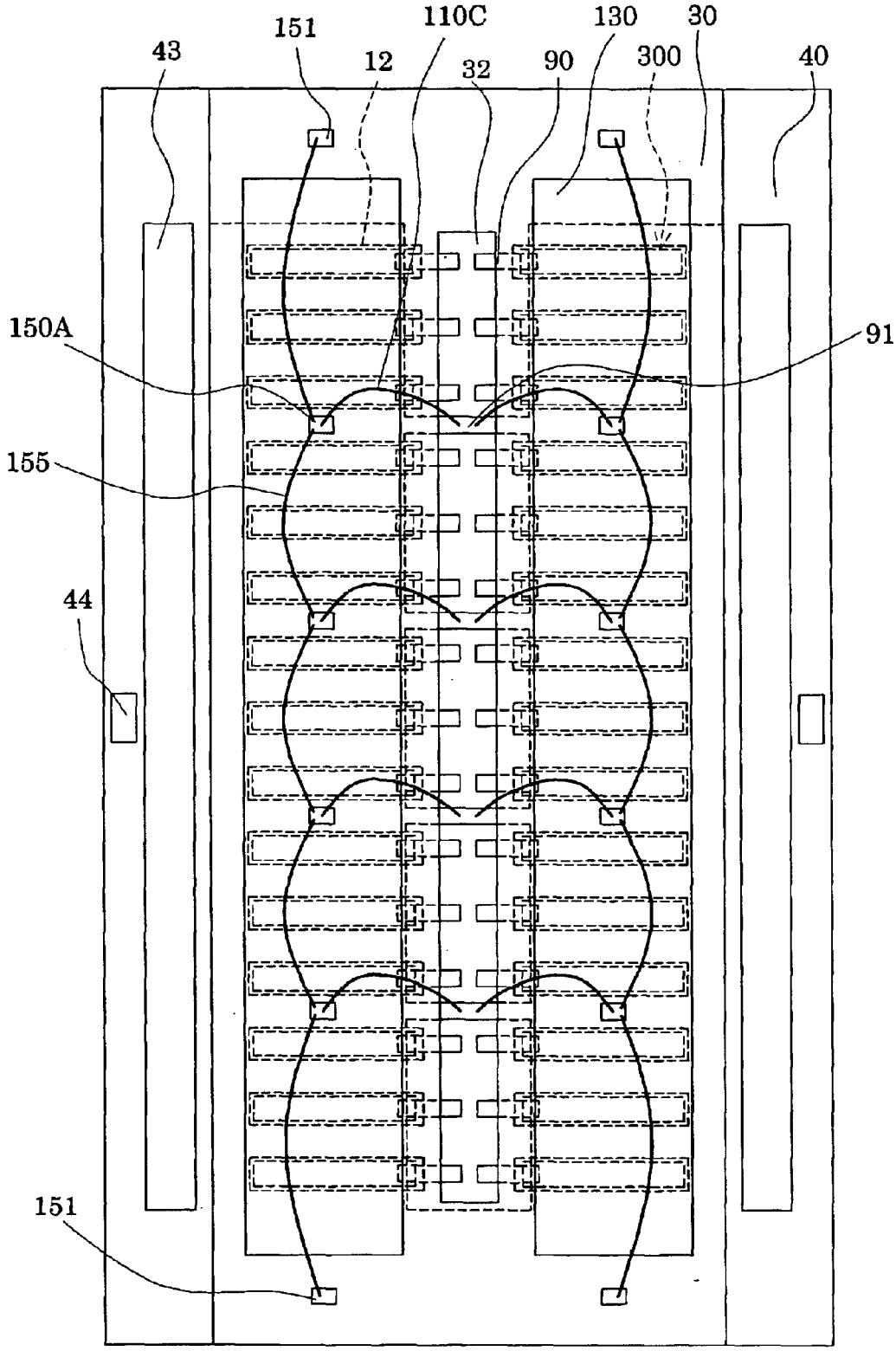
FIG. 8 is a plan view of a recording head according to Embodiment 5.

FIG. 8 is a plan view of an ink-jet recording head according to Embodiment 5. In the ink-jet recording head according to this embodiment, the plurality of conductive layers 150A are formed in an island shape on the respective drive ICs 130 across the direction where the piezoelectric elements 300 are provided parallel as shown in FIG. 8. The conductive layers 150A are made conductive to one another through the coupling wiring 155 composed of conductive wires such as bonding wires. Moreover, the conductive layers 150A and the common lead electrodes 91 are connected to each other by the connection wiring 110C, and the lower electrode film 60 is electrically conductive through the common lead electrodes 91 and the conductive layers 150A. Furthermore, in this embodiment, the conductive layers 151 are also provided on the sealing plate 30 in the outside regions of the rows of the piezoelectric elements 300, and these conductive layers 151 and the conductive layers 150A on the drive ICs 130 are electrically connected to each other through the coupling wiring 155. Other than the above, this embodiment is similar to Embodiment 4. Also with such a constitution, the resistance value of the lower electrode film 60 is substantially lowered, and the occurrence of the voltage drop can be prevented when a large number of the piezoelectric elements 300 are driven simultaneously, and the stable ink ejection characteristics can be obtained similarly to the above-described embodiments.

[Other Embodiment]

Although the present invention has been described above based on the respective embodiments, the constitution of the present invention is not limited to those described above. For example, though the stacked electrode layer 92 is adapted to be provided on the lower electrode film 60 on the outside of the rows of the pressure generating chambers 12 in the above-described embodiments, this stacked electrode layer 92 may not be provided, needless to say, if the resistance value of the lower electrode film 60 can be sufficiently lowered by the common lead electrodes 91 and the connection wiring 110.

Moreover, though the above-described embodiments have been described while exemplifying the ink-jet recording heads, each being constructed to have two rows of the pressure generating chambers 12, it is needless to say that the present invention can be applied to an ink-jet recording head having one row of pressure generating chambers as a matter of course. Moreover, though the ink-jet recording heads of the thin film type, which are manufactured by-applying the deposition and lithography processes, have been exemplified in the above-described embodiments, the present invention is not limited to these ink-jet recording heads as a matter of course. For example, the present invention can be employed for an ink-jet recording head of a thick film type, which is formed by a method such as, for example, adhesion of a green sheet.

Figure 9:
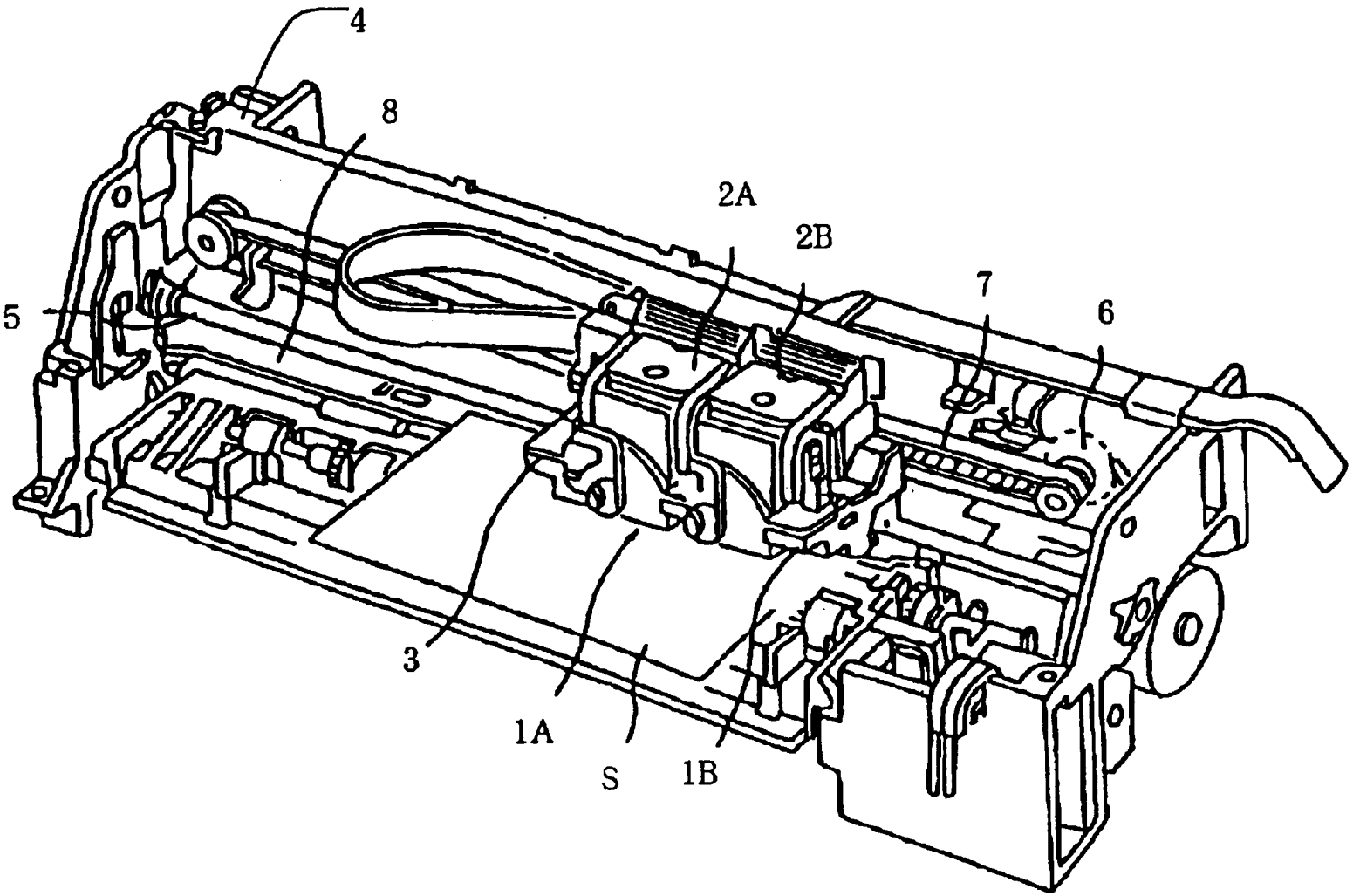
FIG. 9 is a schematic view of a recording apparatus according to one embodiment.

Moreover, the ink-jet recording head of each of these embodiments partially constitutes a recording head unit that is provided with an ink passage communicating with an ink cartridge or the like, and is mounted on an ink-jet recording apparatus. FIG. 9 is a schematic view showing an example of the ink-jet recording apparatus. As shown in FIG. 9, in the recording head units 1A and 1B that have the ink-jet recording heads, the cartridges 2A and 2B, constituting ink supplying means, are detachably provided. The carriage 3 on which these recording head units 1A and 1B are mounted is provided on the carriage shaft 5 attached onto the apparatus body 4 so as to be freely movable in the shaft direction. These recording head units 1A and 1B, for example, are set to eject a black ink composition and a color ink composition, respectively. Then, the drive force of the drive motor 6 is transmitted to the carriage 3 through a plurality of unillustrated gears and the timing belt 7, and thus the carriage 3 on which the recording head units 1A and 1B are mounted is moved along the carriage shaft 5. Meanwhile, the platen 8 is provided onto the apparatus body 4 along the carriage shaft 5. The recording sheet S as a recording medium such as paper fed by an unillustrated paper feed roller or the like is adapted to be conveyed on the platen 8.

Moreover, although the present invention has been described while exemplifying the ink-jet recording head that ejects ink as a liquid-jet head and the ink-jet recording apparatus, the present invention aims to widely cover the overall liquid-jet head and liquid-jet apparatus. As such a liquid-jet head, for example, the following can be given: a recording head for use in an image recording apparatus such as a printer; a color-material-jet head for use in manufacturing a color filter of a liquid crystal display or the like; an electrode-material-jet head for use in forming electrodes of an organic EL display, an FED (field emission display) or the like; a bioorganic-material-jet head for use in manufacturing a biochip; and the like.

What is claimed is:

1. A liquid-jet head comprising:

a passage-forming substrate in which pressure generating chambers communicating with nozzle orifices are formed; and piezoelectric elements for generating pressure changes in the pressure generating chambers, the piezoelectric elements being provided on one surface side of the passage-forming substrate with vibration plate interposed therebetween, wherein a resistance reduction portion is provided to reduce a resistance of a common electrode common to the plurality of piezoelectric elements when a voltage is applied to the piezoelectric elements, the resistance reduction portion including:

common lead electrodes extracted from portions of the common electrode, the portions excluding both end portions in a direction where the piezoelectric elements are provided parallel, to outside regions opposite with the pressure generating chambers; and connection wiring composed of a bonding wire.

2. The liquid-jet head according to claim 1, wherein the plurality of common lead electrodes are extracted from the common electrode, and the common lead electrodes are connected to one another by the connection wiring.

3. The liquid-jet head according to claim 1, further comprising:

a sealing plate joined to the piezoelectric element side of the passage-forming substrate, the sealing plate having a piezoelectric element holding portion to seal the piezoelectric elements, wherein an exposed portion into which surfaces of the common lead electrodes are exposed is provided in a part of the sealing plate, and the connection wiring is provided in the exposed portion.

4. The liquid-jet head according to claim 1, wherein the connection wiring is extended in a direction approximately perpendicular to a direction where the common lead electrodes are provided parallel.

5. The liquid-jet head according to claim 3, further comprising:

an auxiliary wiring layer made of a conductive material on the sealing plate, wherein the auxiliary wiring layer is electrically connected to the common electrode and the common lead electrodes in a region corresponding to an outside of a row of the pressure generating chambers by the connection wiring extended through the exposed portion to constitute a part of the resistance reduction portion.

6. The liquid-jet head according to claim 3, wherein a drive IC is provided on the upper surface of the sealing plate, a conductive portion is provided on the drive IC, and the conductive portion is electrically connected to the common lead electrodes by the connection wiring to constitute a part of the resistance reduction portion.

7. The liquid-jet head according to claim 6, wherein the conductive portion includes a plurality of conductive layers provided intermittingly in an island shape on the drive IC and coupling wiring composed of bonding wires, the coupling wiring electrically connecting the conductive layers to one another.

8. The liquid-jet head according to claim 6, wherein the conductive portion is a conductive layer provided continuously on the drive IC across the direction where the piezoelectric elements are provided parallel.

9. The liquid-jet head according to claim 1, wherein the common lead electrodes are composed of a same layer as that of the common electrode.

10. The liquid-jet head according to claim 1, wherein the common lead electrodes are composed of a same layer as that of individual lead electrodes extracted from individual electrodes of the piezoelectric elements.

11. The liquid-jet head according to claim 1, wherein the common lead electrodes are extended in a same direction as a direction where individual lead electrodes extracted from individual electrodes of the piezoelectric elements are extended.

12. The liquid-jet head according to claim 1, wherein the common lead electrodes are extended in a direction contrary to a direction where individual lead electrodes extracted from individual electrodes of the piezoelectric elements are extended.

13. The liquid-jet head according to claim 1, wherein at least three of the common lead electrodes are provided at an approximately constant interval.

14. The liquid-jet head according to claim 1, wherein two rows of the pressure generating chambers formed by a plurality of compartment walls in the passage-forming substrate are provided, and the common lead electrodes are extended to a region corresponding to a space between the rows of the pressure generating chambers.

15. The liquid-jet head according to claim 1, wherein the pressure generating chambers are formed in a single crystal silicon substrate by anisotropic etching, and respective layers of the piezoelectric elements are formed by deposition and lithography methods.

16. A liquid-jet apparatus comprising the liquid-jet head according to any one of claims 1 to 15.

* * * * *